United States Patent [19]

Baluha

[11] Patent Number: 5,045,154

[45] Date of Patent: Sep. 3, 1991

[54] CONVEYOR EDGE PRODUCT CONTAINING DEVICE FOR PAPER MAKING MACHINERY

[76] Inventor: Mark R. Baluha, 5690 Hackett Rd., Saginaw, Mich. 48603

[21] Appl. No.: 544,970

[22] Filed: Jun. 28, 1990

[51] Int. Cl.[5] ..... D21F 1/56

[52] U.S. Cl. ..... 162/353; 239/566; 162/272; 162/275

[58] Field of Search ..... 162/308–310, 162/272, 275, 353; 239/288, 566, 590.3, 597

[56] References Cited

U.S. PATENT DOCUMENTS

| | | | |
|---|---|---|---|
| 3,607,624 | 9/1971 | Moody et al. | 162/353 |
| 3,839,148 | 10/1974 | Beck | 162/353 |

FOREIGN PATENT DOCUMENTS

| | | | |
|---|---|---|---|
| 2128252 | 10/1972 | France | 162/353 |
| 590390 | 1/1978 | U.S.S.R. | 162/353 |

*Primary Examiner*—Karen M. Hastings

[57] ABSTRACT

An improved conveyor edge product containing device for typical paper making machinery comprised of the main body (20) typically made of ultra-high molecular weight polyethylene conventionally machined with an elongated chamber (30) for fluid distribution to equally spaced nozzles (32) in the machine nozzle slot (34). The device generates a continuous overlapping fan spray pattern (66) creating a seal between the conveyor (52) and the device eliminating side discharge of paper pulp slurry (60).

9 Claims, 5 Drawing Sheets

CONVEYOR EDGE PRODUCT CONTAINING DEVICE FOR PAPER MAKING MACHINERY

BACKGROUND-FIELD OF INVENTION

This invention relates to the production of a conveyor edge product containing device for use in paper making machinery and more particularly, to an improved construction of said device for use on the surfaces of a moving screen type conveyor to contain the product thereon.

BACKGROUND-DESCRIPTION OF PRIOR ART

A multitude of conveyor edge containing devices are known. Typically, such devices are positioned along the upstream edges of the product conveyor (moving continuous screen) to contain the product (pulp fiber slurry) as it is dumped onto the screen. In the Fourdrunier type paper making machine, the slurry is delivered onto the top surface of the screen by a unit called the "headbox", and as it traverses down the length of the machine, the liquid is sufficiently removed to leave the enmeshed pulp fibers in one continuous sheet the width of the conveyor which can than be lifted off of the screen and sent through dryers to obtain the paper product desired. The liquid slurry as it comes out of the headbox onto the conveyor must be contained to prevent it from running off of the edges of the screen. Typically, the devices used to contain the pulp on the edges are elongated boards to which is attached a thin elastomeric sheet of material which is bent in towards the centerline of the screen. This elastomeric material, most commonly neoprene, thus makes physical contact with the screen and provides the facial barrier to prevent liquid pulp from pouring over the sides of the conveyor. The length of these units varies from just a few feet to upwards of sixty feet depending upon the type of paper being made and the preferences of the paper makers.

The inherent deficiencies of these units are five fold: (1) The units often time are quite long and are often difficult to safely handle; (2) The elastomeric material as it is bent to provide the seal tends to shape itself to the units beneath the screen—these devices are generally not flat and thus creates a wavy effect on the elastomer which transfers itself to the moving slurry manifesting uneven pulp fiber distribution; (3) The continuous movement of the conveyor underneath the elastomer eventually wears the elastomer sufficiently to permit liquid pulp from leaking out the sides; (4) The contact of the elastomer with the moving conveyor wears the edges of the screen thus reducing the effective life; (5) The elastomeric material and support board are commonly very different materials and with heating and cooling buckling occurs to the elastomeric material causing pulp flow disruptions.

Another type of unit employs an elastomeric strip attached to a lengthy board or holder with a series of high pressure nozzles located behind the board spraying openly along the back of the unit. As this elastomeric strip is not bent, it requires extremely accurate positioning above the wire to create a sufficient pulp seal—should this strip touch the screen it can quickly cut and thus destroy the screen. The high pressure open nozzles behind this type of unit are designed to clean away leakage which occurs because the unit beneath the wire are not flat and because they are open, form a mist which can then condense along the side of the machine creating possible unsightliness and hazardous conditions.

OBJECTS AND ADVANTAGES

Accordingly, besides the objects and advantages of the conveyor edge product containing device described in my above patent, several objects and advantages of the present invention are:

(a) to provide an improved conveyor edge product containing device of a paper making machine wherein the problems caused by direct contact of sealing devices with the conveyor are eliminated.

(b) to provide an improved conveyor edge product containing device regardless of the contour of the devices below the conveyor.

(c) to provide an improved conveyor edge product containing device which is of manageable size and weight whereby one person can safely install or remove such device without danger of damage to the very costly conveyor material.

(d) to provide an improved conveyor edge product containing device which contains and controls any minor leakage of liquid pulp toward the conveyor edge and contain and control excessive mist associated with open spraying devices.

Further objects and advantages will become apparent from a consideration of the ensuing description and drawings.

REFERENCE NUMERALS IN DRAWINGS

| | |
|---|---|
| 20 main deckle body | 22 seal plate |
| 24 standard pipe threaded hole | 26 standard bolts |
| 28 conventional "0" rings | 29 an "0" ring groove |
| 30 liquid or pneumatic distribution chamber | 32 nozzles |
| 34 nozzle slot | 40 tapped through holes |
| 48 Distance to conveyor/wire or screen | 50 width of nozzle spray |
| 52 conveyor | 54 paper machine headbox |
| 56 brackets | 58 headbox side plate |
| 60 paper pulp slurry | 62 edge of wire |
| 64 side of paper making machinery | 66 overlap of fan spray |
| 68 overspray | 70 fan spray |

DESCRIPTION

FIGS. 1 to 5*b*

Figure 1:
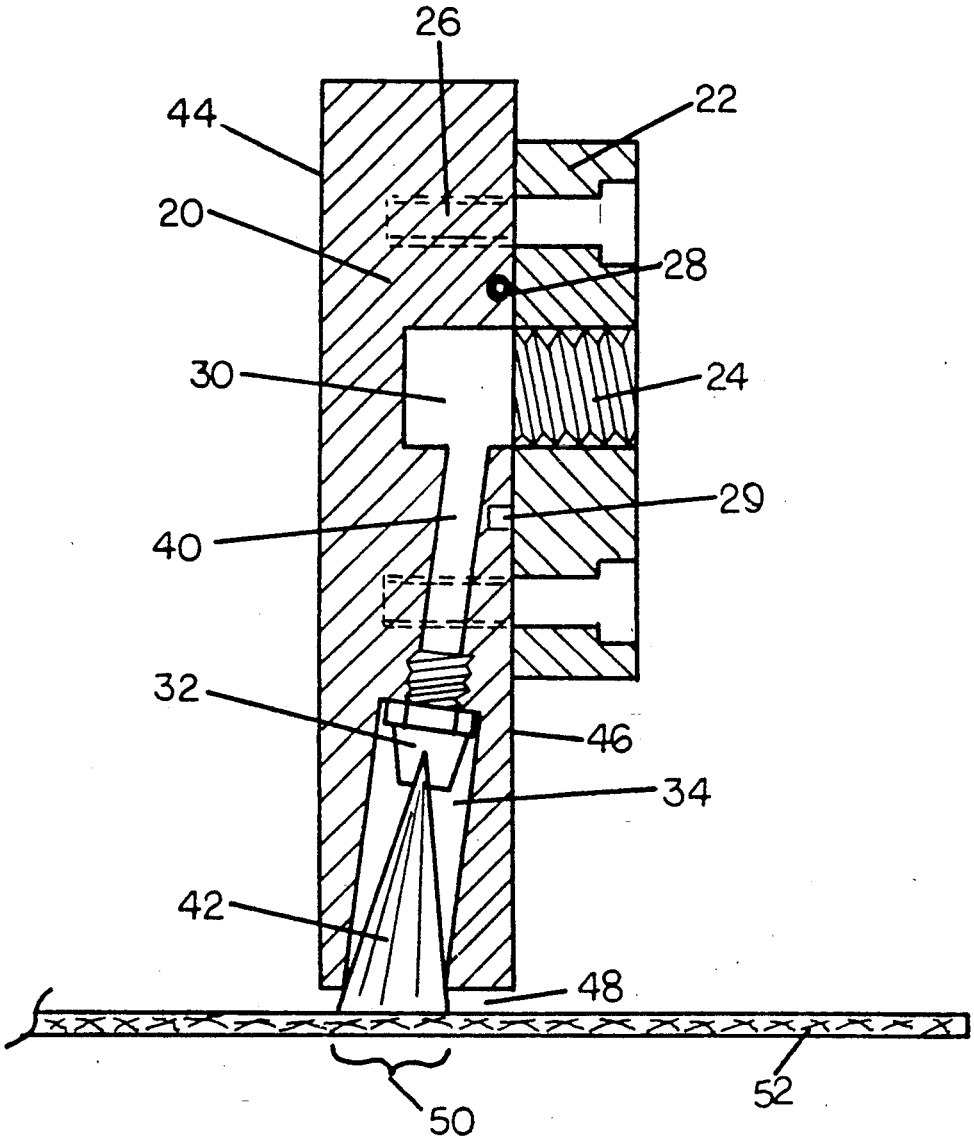
FIG. 1 shows a cross sectional view of the conveyor edge product containing device.
Figure 2:
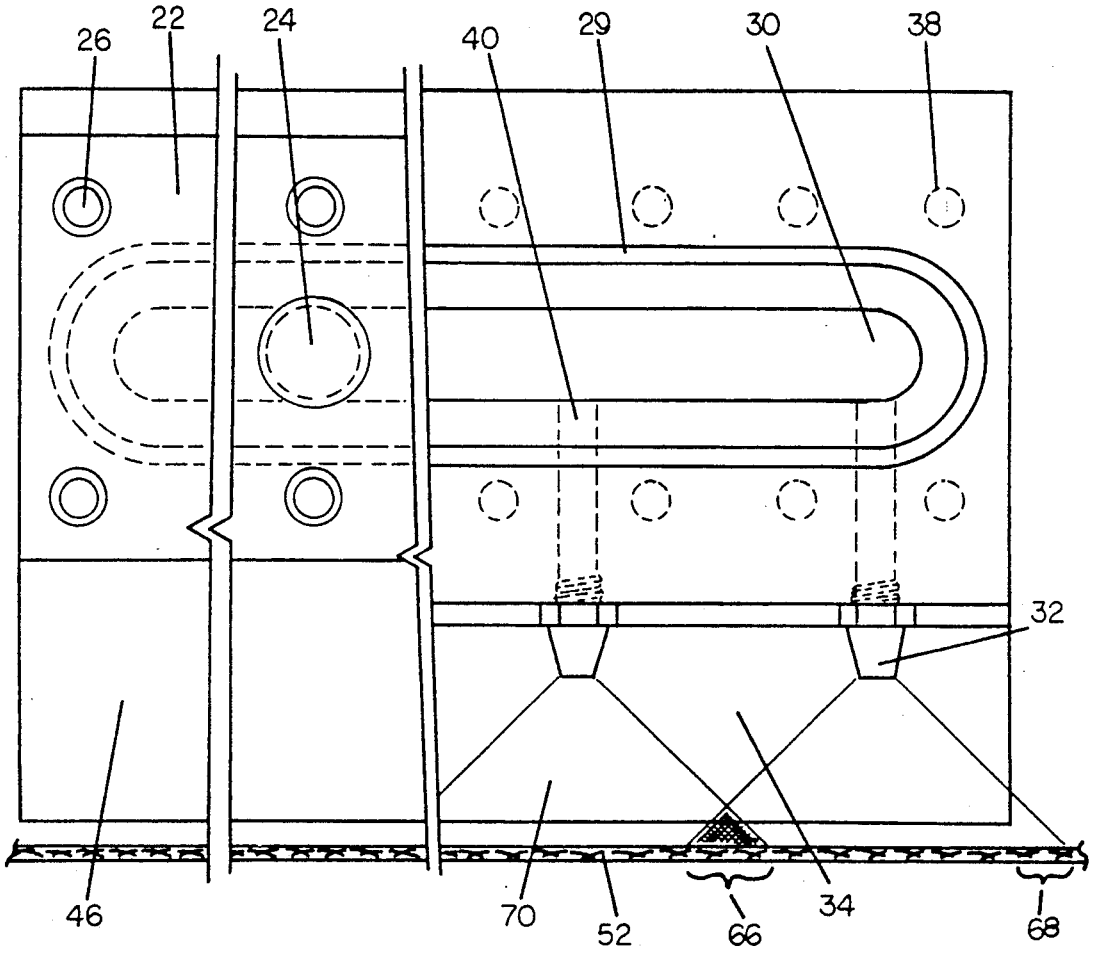
FIG. 2 shows a side view with seal-plate cutaway and cross sectional cutaway.
Figure 3A:
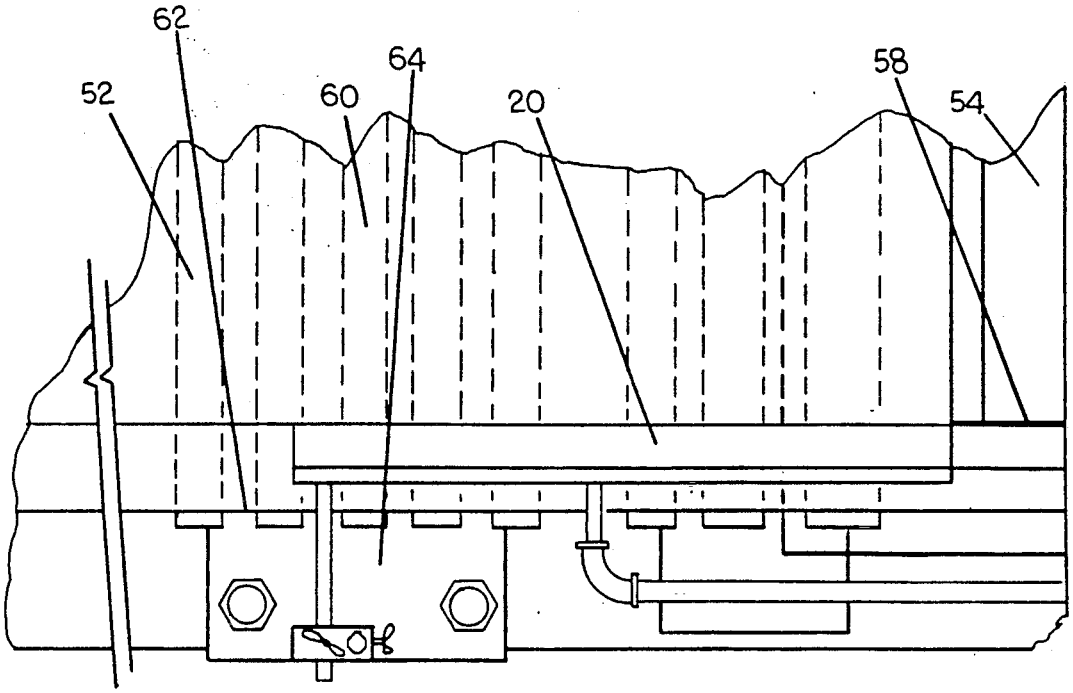
FIG. 3*a* shows a top view of conventional paper making machinery showing standard location of the conveyor edge product containing device.
Figure 3B:
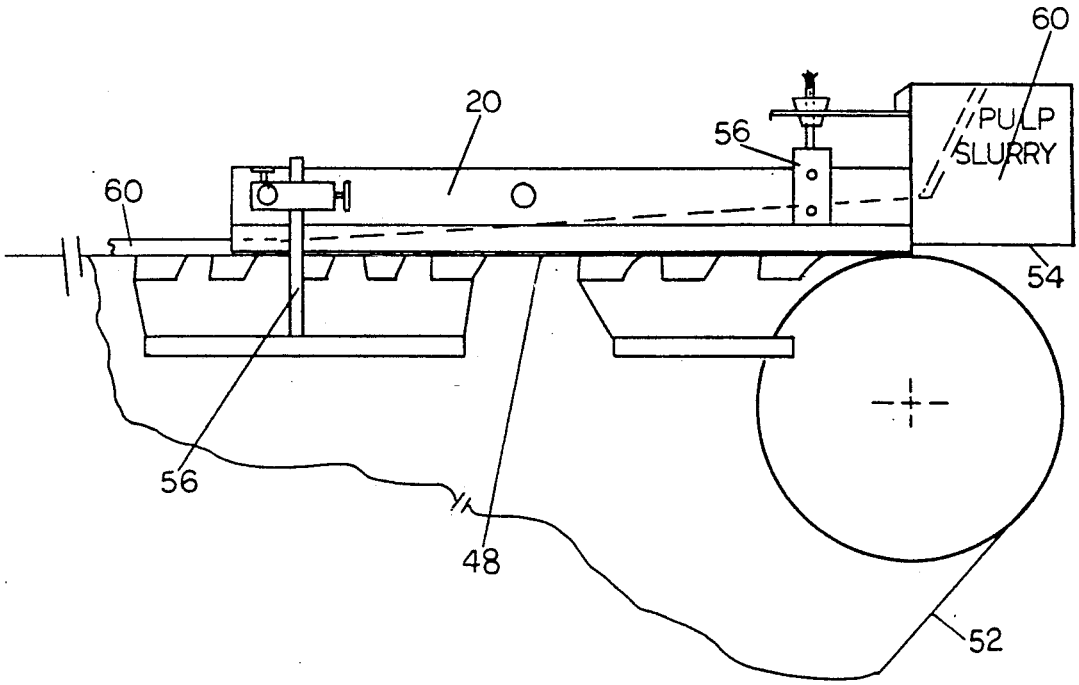
FIG. 3*b* shows a side view of conventional paper making machinery showing standard location of the conveyor edge product containing device.
Figure 4B:
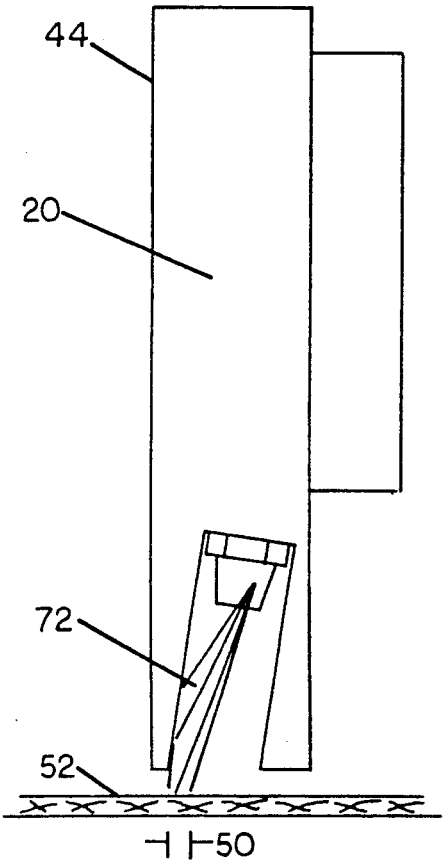
FIG. 4*b* shows a cross sectional view of alternate spray pattern.
Figure 4A:
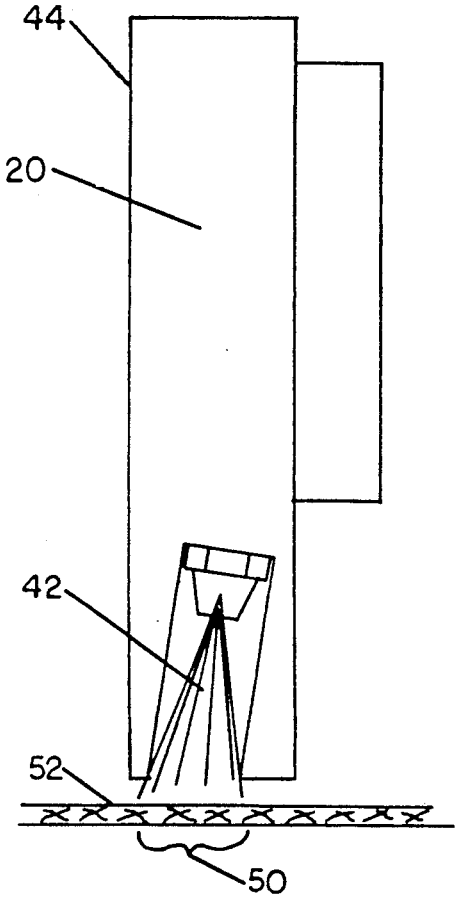
FIG. 4*a* shows a cross sectional view of standard spray pattern.
Figure 5A:
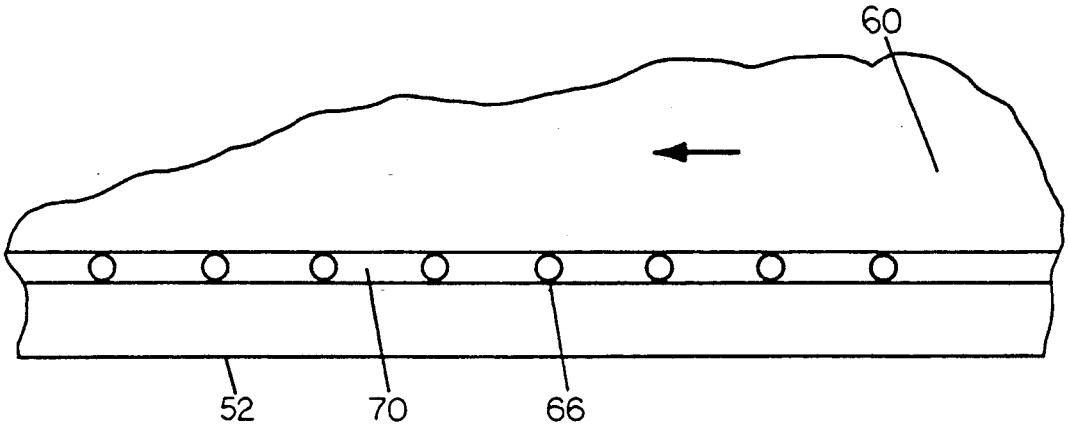
FIG. 5*a* shows a top view of standard overlapping fan spray patterns.
Figure 5B:
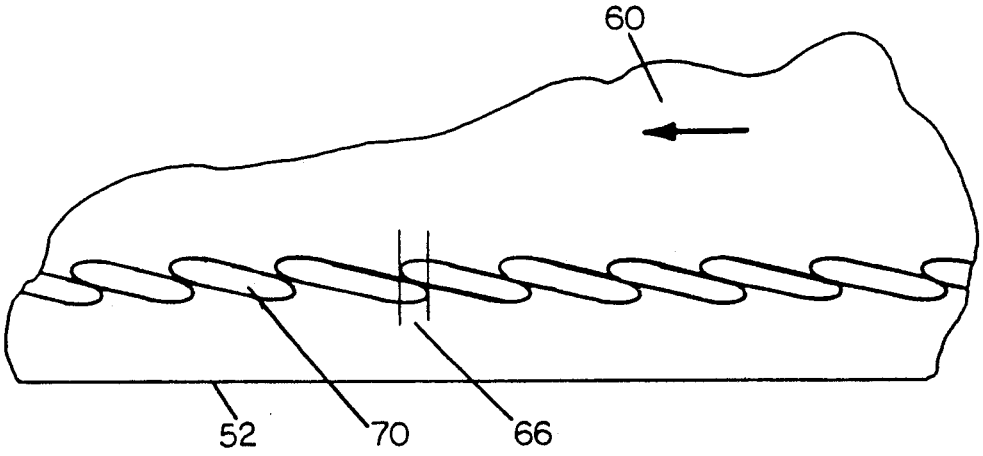
FIG. 5*b* shows a top view of alternate fan spray patterns.

Referring more specifically to the drawings, FIG. 1 illustrates an end view vertical cross section. A typical preferred embodiment of the conveyor edge product containing device of the present invention—commonly referred to as "deckle." In use, typically, FIGS. 1 and 2, the main deckle body (20) is made of ultra-high molecular weight polyethylene (UHMW) measuring 36 inches long, 6 inches high and 1¼ inches wide, which can be machined by conventional methods to contain a liquid or pneumatic distribution chamber (30), an "O" ring groove (29) to provide the liquid or pneumatic seal with conventional "O" rings (28) to the seal plate (22) made of the same material as the main deckle body to prevent distortion due to thermal expansion and secured to the main body with standard bolts (26). The main body also has a continuous open self cleaning rectangular nozzle slot (34) machined on an angle which allows drilling of the tapped through holes (40) connecting the liquid or pneumatic distribution chamber to the nozzle slot (34). The nozzles (32) are typically solid flat fan spray nozzles designed to provide overlapping sprays (FIG. 5*a* and *b*) (66) of typical widths of ½ inch maximum (50) on the conveyor (52).

The deckle is attached to the paper machine headbox (FIG. 3*a* and *b*) (54) via custom designed brackets (56) which permits simple up-down and in-out adjustments of the deckle in relation to the distance to conveyor or wire or screen (48) which can be set at a minimum 0.005 inch, typically 0.080 inch, above the wire, and in line with or slightly outside of the headbox side plate (58). Proper setting of these adjustments contains the paper pulp slurry (60) along the edge of the wire (62) and prevents pulp from running off the edge onto the side of the paper making machinery (64). The liquid or pneumatic connection to the deckle is a standard pipe threaded hole (24) in the seal plate (22) to which standard controlled flow and pressure lines can be connected. A typical operating media is water at 40 PSI and 30 gallons per minute. This spray mist at a minimum with the fan spray (70) overlapping (66) nozzle to nozzle with the nozzles on either end overspraying (68) the ends.

SUMMARY, RAMIFICATIONS, AND SCOPE

Briefly, the present invention comprises an improved conveyor edge product containing device for use in paper making machinery having an embodiment made up of the base body, typically 36 inches long, 1¼ inches wide and 6 inches high, which is machined or molded to contain an elongated chamber on the top portion of the 6 inch face which acts as a fluid distribution chamber when closed off by a seal plate with typically a single fluid inlet part and a rectangular slot opening on the bottom 1¼ inch face machined or molded on an angle whereby the opening of the slot leaves a very narrow flat on the 1¼ inch face opposite the six inch face containing the fluid distribution chamber and at an angle which permits drilling and tapping connecting holes from the slot to the fluid distribution chambers. On the bottom and in the centerline of this slot holes are drilled along the 36 inch length at the angle of the slot connecting the slot to the fluid distribution chamber and these holes are subsequently tapped to accept a series of fan-spray nozzles. The depth of the slot from the bottom of the 1¼ inch face and the distance the tapped holes are spaced from either end of the 36 inch length and from each other are determined by the fan width at specific distances given by the particular nozzles chosen to permit at least ⅛ inch of spray overlap because of this spray overlap the overall effect is to develop a continuous spray pattern being typically at least 36 inches long and ¼ inch wide at the opening of the slot, on the same angle as the slot and contained within. The width of the slot is determined as the minimum required to install above said nozzles typically ⅝ inch or one inch.

These units which are typically light weight and can be readily handled by one person, are attached to the paper machine by brackets which allow the units to be accurately suspended above the conveyor at a minimum distance of five thousandths of an inch and abutted to the headbox exactly in-line with or slightly away from the flow of the pulp slurry out of the headbox. These units are installed so that the fluid inlet, typically water, on the seal plate attached to the upper 6 inch face is away from the side of the conveyor and the angled slot with the nozzles can form a continuous connected spray onto the conveyor angled toward the center line of the screen. This fluid spray pattern forms a boundary within the slotted chamber and onto the conveyor which effectively contains the pulp slurry on the screen. The volume of fluid required to contain the slurry along the outer edges of the conveyor screen is determined by the type and speed of the paper being cast.

In a preferred embodiment the base body is made of a strong, wear resistant, light weight and non-abrasive material such as ultra-high molecular weight polyethylene, in which the fluid distribution chamber, the slot, and the tapped holes can readily be machined in by conventional techniques. The seal plate is made of the same material to preclude distortion of the base body by thermal expansion differences, and the seal itself is obtained with continuous "O" ring material and grooves. Into the seal plate is drilled and tapped a conventional pipe thread to permit standard attachment of fluid lines, and the seal plate itself is secured to the base body with conventional screws. The nozzles utilized are a standard fan spray type which yield a wide fan, narrow in width, and solid in nature at a short distance at standard flows and pressures. Some paper machines may require custom made nozzles which increase the angle of spray above the angle of the slot to place the spray on the very inside face of the slot towards the conveyor centerline. The spacing between nozzles is such that a minimum of ⅛ inch spray overlap occurs from nozzle fan to nozzle fan and a minimum of ¼ inch overspray on either end of the board permitting ganging of boards if necessary.

Although the description above contains many specificities, these should not be construed as limiting the scope of the invention but as merely providing illustrations of some of the presently preferred embodiments of this invention. For example, this product can have other shapes, lengths and dimensions such as square, circular, round or trapezoidal, etc. The main body and plate could be manufactured out of other materials such as steel (i.e. a metal) or rubber (i.e. an elastomeric material), etc. Also, the seal plates could be modified, eliminated etc and the distribution chamber and shape and size of the nozzle slot could be modified by length, shape, size etc.

Thus the scope of the invention should be determined by the appended claims and their legal equivalents, rather than by the examples given.

I claim:

1. In papermaking machinery, a relatively rigid elongate deckle board acting as a conveyor edge product containing device comprising:

an elongate rectangular main body having a top, a bottom, two elongate sides, and two short sides;

a continuous rectangular nozzle slot defined in a cross section of three sides by the main body and open on the bottom and the two short sides, and positioned at an angle relative to one of the elongate sides;

a central distribution chamber having a length almost the length of the main body and open at said one of the elongate sides;

a seal plate covering said distribution chamber at said open elongate side;

a plurality of angled holes connecting said distribution chamber to said angled slot;

a plurality of spaced solid, flat, fan spray nozzles located in said nozzle slot in said angled holes structured and arranged so that the spray from each nozzle overlaps creating a continuous spray barrier confined in the nozzle slot except on the said two short sides which prevents side discharge of paper pulp slurry along an edge of a continuous conveyor used on the papermaking machine.

2. The deckle board of claim 1, wherein the main body is made of polyethylene.

3. The deckle board of claim 1, wherein the seal plate is made of polyethylene.

4. The deckle board of claim 1, wherein the main body is made of metal.

5. The deckle board of claim 1, wherein the seal plate is made of metal.

6. The deckle board of claim 1, wherein the main body is made of elastomeric material.

7. The deckle board of claim 1, wherein the seal plate is made of elastomeric material.

8. The deckle board of claim 1, wherein the main body and the seal plate are made of the same material.

9. The deckle board of claim 1, wherein said nozzles are turned relative to one another to form angled solid fan spray patterns on the said continuous conveyor.

* * * * *